US005200296A

United States Patent [19]

Nagamatsu et al.

[11] Patent Number: 5,200,296

[45] Date of Patent: Apr. 6, 1993

[54] IMAGE RECEIVING MATERIAL FOR SILVER COMPLEX DIFFUSION TRANSFER PROCESS

[75] Inventors: Hiroaki Nagamatsu; Susumu Baba; Tatsuhito Taniguchi, all of Tokyo, Japan

[73] Assignee: Mitsubishi Paper Mills Limited, Tokyo, Japan

[21] Appl. No.: 865,190

[22] Filed: Apr. 8, 1992

[30] Foreign Application Priority Data

May 14, 1987 [JP] Japan ..... 3-138224
Apr. 10, 1991 [JP] Japan ..... 3-104637
May 14, 1991 [JP] Japan ..... 3-138225

[51] Int. Cl.[5] ..... G03C 5/54

[52] U.S. Cl. ..... 430/232; 430/227; 430/231; 430/233; 430/933; 430/965

[58] Field of Search ..... 430/227, 231, 232, 233, 430/933, 965

[56] References Cited

U.S. PATENT DOCUMENTS 3,567,442 3/1971 Land ..... 430/232
4,376,157 3/1983 Tsubai et al. ..... 430/232
4,859,566 8/1989 DeKeyzer ..... 430/232

*Primary Examiner*—Richard L. Schilling
*Attorney, Agent, or Firm*—Cushman, Darby & Cushman

[57] ABSTRACT

Provided is an image receiving material for silver complex diffusion transfer process which comprises a support, an image receiving layer provided on the support and an upper layer provided on the image receiving layer wherein physical development nuclei are distributed densely in the vicinity of the surface of the support and gradually diminishing towards the upper layer and a color toning agent is contained densely in the upper layer and gradually diminishing towards the surface of the support and the physical development nuclei and the color toning agent are thus mutually distributed. The image receiving material is produced by coating on a support a hydrophilic colloid coating solution for image receiving layer which contains physical development nuclei and contains substantially no color toning agent and thereon at least one hydrophilic colloid coating solution which contains at least one color toning agent and contains substantially no physical development nuclei. The physical development nuclei are preferably prepared by reducing or sulfurizing a heavy metal ion in a solution containing low molecular weight gelatin as defined in the specification.

6 Claims, No Drawings

IMAGE RECEIVING MATERIAL FOR SILVER COMPLEX DIFFUSION TRANSFER PROCESS

BACKGROUND OF THE INVENTION

The present invention relates to a silver complex diffusion transfer process (DTR process) and an image receiving material used therefor.

In DTR process the silver salt is transferred imagewise from a silver halide emulsion layer to an image receiving layer through diffusion and is converted to a silver image, in many cases, in the presence of physical development nuclei. For this purpose, the silver halide emulsion layer exposed imagewise is brought about in contact with the image receiving material in the presence of a developing agent and a silver halide complexing agent to convert the undeveloped silver halide to a soluble silver complex salt. Silver halide in the exposed portion of the silver halide emulsion layer is developed (chemical development) to silver, which therefore can no longer be dissolved and diffused. Silver halide in the unexposed portion of the silver halide emulsion layer is converted to a soluble silver complex salt, which forms a silver image, usually, in the presence of physical development nuclei. In the case of direct positive silver halide emulsion, action of the exposed portion and that of unexposed portion are reversed.

The DTR process has many uses. Especially, in the case of DTR process for reproduction of documents and production of block copies, it is required that the silver image formed on the image receiving material has high contrast and high maximum density and is of pure black and no fog occurs in non-image portion and whiteness of the non-image portion is high. However, it is known that the transferred silver image formed by such DTR process is generally not black, but has brown or other unacceptable colors. In order to solve these defects of DTR process, color toning agents are used. Various compounds are known as the color toning agents and a typical example thereof is 1-phenyl-5-mercaptotetrazole. However, when color tone satisfactory to some extent is obtained by using known color toning agents, there may occur considerable reduction in density or reduction in transfer rate.

Moreover, as processes for preparing physical development nuclei suitable for such image receiving materials, there have been known a process which comprises reducing a corresponding metal ion in an aqueous solution of a water-soluble polymer such as gelatin, a gelatin derivative, polyvinyl alcohol, carboxymethyl cellulose or the like to produce a metallic colloid dispersion and a process which comprises mixing a metallic ion with a solution of a soluble sulfide, a selenide or a telluride to produce a colloid dispersion of a water-insoluble metal sulfide, a metallic selenide or a metallic telluride.

However, the inventors have found that physical development nuclei prepared by these processes vary in their activity depending on the kind of the water-soluble polymer used and physical development nuclei of high activity generally tend to give transfer silver images of considerably reddish color tone with metallic gloss (bronzing) on the surface and on the other hand, physical development nuclei which give transfer silver images of satisfactory color tone with no bronzing phenomenon tend to be low in activity.

Furthermore, use of physical development nuclei in a larger amount within the range of commonly used amount can provide higher maximum density, but there are problems that considerable metallic gloss (bronzing) occurs on the surface of transfer silver images and besides, color tone is also deteriorated.

On the other hand, from the aspect of layer construction, it has been known that bronzing can be inhibited by providing a layer containing no physical development nuclei on an image receiving layer containing physical development nuclei. That is, Japanese Patent Kokai No. 1-94344 discloses a method for forming a sharp image having no metallic gloss in a short processing time and a short drying time by using an image receiving material in which the total solid coating amount of an image receiving layer and a water-permeable uppermost layer is 2 g/m$^2$ or less.

Metallic gloss of transfer silver image can be controlled by providing the uppermost layer since physical development nuclei are not present on the surface and hence physically developed silver is not concentrated on the surface. However, even if conventionally used uppermost layers can inhibit metallic gloss, color tone of the produced transfer silver image is inferior or transfer density is insufficient.

In this case, although maximum density is somehow satisfactory, deterioration of color tone cannot be inhibited. Furthermore, when the two layers are provided, there is the problem of reduction in texture of black in the transfer silver image portion (for example, sordid black, cloudy black or brownish black when obliquely viewed though satisfactory black is seen when viewed from right above).

Further, the high whiteness of non-image portion on the image receiving material is also an important quality. For obtaining high whiteness, fluorescent brightening agents are used, but use of fluorescent brightening agents affects the quality of transfer silver image as shown in Japanese Patent Kokai No. 1-246539.

As explained above, it has been demanded to find methods of using fluorescent brightening agents which improve whiteness of non-image portion without affecting transfer silver image. Satisfactory methods have not yet been found.

Besides, rapid processing of photographic materials has recently been demanded and for this purpose, improvement of photographic materials per se to meet the rapid processing and improvement of processing solutions in conformity with such photographic materials have been attempted. For example, it is attempted to reduce amount of gelatin used in photographic materials and to make the layers thinner in order to attain rapid diffusion of processing solution. However, such methods cause not only deterioration of film properties, but also increase of fog. Therefore, film properties of high mechanical strength and causing no damage of photographic characteristics are demanded since now short-time processing at high temperatures using automatic processors or high energy processing solutions becomes popular.

There are quaternary pyridinium compounds described in Japanese Patent Kokai Nos. 56-36645 and 59-20369 as hardeners which do not cause various defects as mentioned above. It has become clear that these compounds not only have no aforementioned defects, but also extremely improve color tone and maximum density of image portion when they are used as hardeners in image receiving materials for silver complex diffusion transfer process.

In general, hardeners are required to provide coating solutions with time stability in use. Time stability of from several hours to several ten hours may sometimes be needed depending on manner of coating. This problem is solved, for example, by adjusting pH to 6 or more in case of generally used 2-hydroxy-4,6-dichloro-1,3,5-triazine.

However, it has been difficult to improve time stability by these methods using the quaternary pyridinium compounds described in the above-mentioned Japanese Patent Kokai Nos. 56-36645 and 59-20369.

SUMMARY OF THE INVENTION

An object of the present invention is to provide an image receiving material for silver complex diffusion transfer Process which gives images of high density and good color tone.

Another object of the present invention is to provide an image receiving material for silver complex diffusion transfer process which gives images with no bronzing.

Still another object of the present invention is to provide an image receiving material for silver complex diffusion transfer process which gives images having good texture.

Further object of the present invention is to provide an image receiving material for silver complex diffusion transfer process which gives non-image portions improved in whiteness without deterioration of quality of transfer silver images.

Still another object of the present invention is to provide an image receiving material for silver complex diffusion transfer process which gives images improved in the above-mentioned various qualities and which can be produced stably by improving time stability of coating solutions containing hardners.

As a result of intensive research conducted by the inventors on improvement of qualities of transfer images formed by silver complex diffusion transfer process, it has been found that construction of layers of image receiving materials and control of distributions of physical development nuclei and color toning agent are essential for attaining the objects. Namely, above objects have been attained by providing an image receiving material for silver complex diffusion transfer process which comprises a support, an image receiving layer provided on the support and an upper layer provided on the image receiving layer wherein physical development nuclei are distributed densely in the vicinity of the surface of the support and gradually diminishing towards the upper layer and a color toning agent is contained densely in the upper layer and gradually diminishing towards the surface of the support and the physical development nuclei and the color toning agent are thus mutually distributed.

DESCRIPTION OF THE INVENTION

The present invention will be explained in more detail.

It has been known that bronzing can be inhibited with maintaining transfer density by providing a layer containing no physical development nuclei on an image receiving layer, but there are problems that color tone cannot be improved and texture of images deteriorates. When distribution of physically developed silver particles in the section of layers in the depth direction in this case is observed, the physically developed silver particles are precipitated only in the image receiving layer and substantially no physically developed silver particles are present in the upper layer.

It can be easily understood that bronzing occurs owing to precipitation of physically developed silver particles on the surface of images. Therefore, when the layer containing no physical development nuclei is provided on the image receiving layer, the upper layer completely covers precipitated silver in the image receiving layer and thus, to provide the upper layer is extremely effective for inhibition of bronzing. On the other hand, however, it is considered that when two layers are clearly formed in this way, deterioration of texture of images occurs due to the presence of the surface layer.

Under the circumstances, the inventors have attempted to make an image receiving material which has a double layer construction, but does not have distinct layers. The resulting image receiving material can give images with no bronzing and with high density and excellent texture.

When distribution of physically developed silver particles in a section of such image receiving material is observed, it has been found that the distribution gradually changes from dense state in the vicinity of the surface of a support towards sparse state in the upper layer and substantially no physically developed silver particles are precipitated on the surface of the upper layer. Furthermore, when attention is paid to the size of the precipitated physically developed silver particles, it has been found that the particles present near the surface of the support are finer and those present near the surface of the upper layer are coarser.

However, when changes in transfer silver image have been observed with changing amount of physical development nuclei used in the image receiving material of such construction, even if the nuclei are used in an amount more than that usually employed, no change has occurred in bronzing and redness has increased in color tone with increase in content of the nuclei though texture of the image is further improved.

Therefore, the inventors have tried to use a color toning agent in the image receiving material which has the above construction and which contains physical development nuclei in an amount larger than the amount usually employed.

In the receiving material of the construction employed here, there are roughly three methods for containing color toning agent.

That is, the first is to contain the color toning agent in only the image receiving layer, the second is to contain the color toning agent equally in the image receiving layer and the upper layer, and the third is to contain the color toning agent in only the upper layer. Explanation will be made with reference to use of 1-phenyl-5-mercaptotetrazole.

Image receiving materials which contain 1-phenyl-5-mercaptotetrazole in the above-mentioned three manners were prepared and comparison was made on transfer silver image formed thereon to find that the agent had a great effect on color tone when it was contained in only the image receiving layer and it was contained equivalently in the image receiving layer and the upper layer, but considerable reduction in density and considerable deterioration in texture (the color becomes sordid when obliquely seen) were observed especially when the agent was contained in only the image receiving layer while only the color tone was improved without damaging density and texture when 1 phenyl-5-mercaptotetrazole was contained in only the upper layer.

When state of physically developed silver particles in a section of a sample containing 1-phenyl-5-mercaptotetrazole in only the upper layer was compared with that of Physically developed silver particles when 1-phenyl-5-mercaptotetrazole was not used, size of the silver particles wa large through the whole layers and the distribution was such that the silver particles present in the position closer to the upper layer were larger in size and those present in the position closer to the support were smaller in size. Thus, it can be seen that the color toning effect is exerted not only on the upper layer to which the color toning agent is added, but also on the lower layer in proportion to the distance from the upper layer and the color toning agent diffuses also into the lower layer and is distributed therein by employing a double layer construction in which the layers are present in indistinct state in their boundary.

The image receiving material which has a double layer construction, but does not have distinct layers is produced preferably by coating and drying an image receiving layer containing physical development nuclei (lower layer), then coating thereon an upper layer containing a color toning agent and drying the layer at a temperature higher than usually employed (at which gelatin binder is not set or is insufficiently set). However, it is also possible to simultaneously coat the layers, for example, by extrusion method when initial drying temperature is raised within the range where the gelatin layer does not flow and a uniform film can be formed.

As the color toning agents used in the present invention, mention may be made of those which are normally used in diffusion transfer process, for example, those which are described in "Photographic Silver Halide Diffusion Process" page 61, published from Focal Press Co. More preferred are 1-phenyl-5-mercaptotetrazole and 1-phenyl-5-mercaptotetrazole which has a substituent on phenyl group, 1-aralkyl-5-mercaptotetrazoles described in Japanese Patent Kokai No. 2-207251, and benzotriazole and derivatives thereof.

Amount of the color toning agent used in the present invention may vary depending on the kind of the agent, but generally is in the range of 5–500 mg/m$^2$.

In the present invention, "the coating solution for image receiving layer contains substantially no color toning agent" should be construed to include not only the case when the solution does not contain the color toning agent at all, but also the case when it contains the color toning agent in such a small amount as not hindering attainment of the objects of the present invention.

As physical development nuclei used in the image receiving material of the present invention, there may be used those which are normally used in image receiving materials for silver complex diffusion transfer process, for example, colloid dispersions of metals such as silver, gold, platinum, palladium, copper, cadmium, lead, cobalt and nickel, and sulfides and selenides thereof. Sufficient effect to improve the quality can be obtained by using the above-mentioned nuclei by distributing the physical development nuclei and the color toning agent with each other. However, the effect can be further enhanced by using physical development nuclei prepared by reducing or sulfurizing a heavy metal ion in a low molecular weight gelatin solution as explained hereinafter.

The gelatins include alkali-treated gelatins, acid-treated gelatins and gelatin derivatives treated or modified by various processes and usually have an average molecular weight of several ten thousands to several hundred thousands. Measurement of molecular weight can be carried out by end-group analysis, analysis of amino acid composition, light-scattering method, gel filtration method, ultracentrifuging, surface pressure method and the like.

It is said that gelation of gelatins occurs when their average molecular weight is about 30,000 or more. Those which are commonly used as photographic gelatins have an average molecular weight of about 100,000, generally about 70,000 to about 150,000. In other words, gelatins of less than about 30,000 in average molecular weight do not gel or very slightly gel and are not commonly used for photographic purpose.

The term "low molecular weight gelatins" used in this specification means gelatins having the above property different from those of common photographic gelatins.

General molecular weight of the low molecular weight gelatins is about 3,000–about 30,000, preferably about 5,000–about 20,000. Photographic gelatins also naturally contain some gelatin component of low molecular weight, but the low molecular weight gelatin of the present invention is distinguished therefrom.

For the low molecular weight gelatins of the present invention, gelatins of optional average molecular weights can be obtained by setting the conditions for hydrolysis of main chain peptide bond of collagen obtained from bones and skins of, for example, cow, pig and sheep. They can also be obtained by enzyme decomposition treatment.

The low molecular weight gelatin solution used for preparation of physical development nuclei has a concentration of preferably about 0.5–50% by weight, more preferably 3–20% by weight. In addition to the low molecular weight gelatins, the solution may contain water-soluble polymers generally used for preparation of physical development nuclei such as usual gelatins, derivative gelatins, polyvinyl alcohol, and carboxymethyl cellulose, but these are not preferred to be contained in an amount more than the weight of the low molecular weight gelatin.

The heavy metals of physical development nuclei used in the present invention are those which are generally used as physical development nuclei such as silver, gold, platinum, palladium, copper, cobalt and nickel. Preferred are silver, gold and palladium when they are reduced and used, and silver, palladium cobalt and nickel when they are sulfurized, and combinations of a plurality of heavy metals such as nickel with silver and cobalt with silver are also preferred. Furthermore, when a combination of a plurality of heavy metals are used in the form of sulfide, physical development nuclei having the double-layer structure as disclosed in Japanese Patent Kokai No. 63-249845 are further preferred.

As reducing agents used when the heavy metals are reduced, there may be used compounds known as developing agents such as hydroquinone and derivatives thereof and ascorbic acid, dextrin, sodium borohydride, potassium borohydride and the like. As sulfurizing agents used when the heavy metals are sulfurized, there may be used sodium sulfide, potassium sulfide, ammonium sulfide and the like.

These reducing agents or sulfurizing agents are used in an amount in the range of about 0.5 mol–about 5 mols, preferably 0.8–3 mols per 1 mol of the heavy metal.

A general process for preparation of physical development nuclei used in the present invention comprises mixing an aqueous solution of a heavy metal ion with an aqueous solution of the reducing agent or the sulfurizing agent in a low molecular weight gelatin solution under thorough stirring. In this case, sequence of mixing of the heavy metal ion and the reducing agent or the sulfurizing agent with the low molecular weight gelatin solution may be optional, but when a part of the heavy metal ion forms an insoluble matter with the low molecular weight gelatin, the reducing agent or sulfurizing agent in an amount equivalent to or excess of the amount of the heavy metal ion is mixed with the low molecular weight gelatin solution prior to the heavy metal ion.

Amount of physical development nuclei contained in the thus prepared solution of physical development nuclei colloid dispersion is in the range of $10^{-4}$ mol/l-1 mol/l as a total amount of reduced metals or metal sulfides.

Amount of the physical development nuclei contained in the image receiving layer of the present invention is in the range of about $10^{-6}$ mol/m$^2$-about $10^{-4}$ mol/m$^2$ as a total amount of the reduced metals or the metal sulfides.

coated, thickness of the layer after dried is preferably in the range of 0.1-3.0 μm, more preferably in the range of 0.4-1.5 μm.

Coating solution for the upper layer coated on the image receiving layer is preferably prepared so that when it is singly coated, thickness of the layer after dried is preferably in the range of 0.4-2.0 μm, more preferably in the range of 0.8-1.5 μm.

Improvement in whiteness of non-image portion has been attained by containing an oil-soluble fluorescent brightening agent emulsified dispersion in one or more of the coating solutions required for forming the image receiving material of the above construction other than the coating solution for forming the uppermost layer.

As the oil-soluble fluorescent brightening agents used in the present invention, for example, substituted stilbenes or substituted cumarins described in British Patent No. 786,234 and substituted thiophenes described in U.S. Pat. No. 3,135,762 are effective and fluorescent brightening agents disclosed in Japanese Paten Kokoku No. 45-37376 and Japanese Patent Kokai No. 50-126732 are especially effective.

Typically effective fluorescent brightening agents are those which have one of the following formulas (3)-(6).

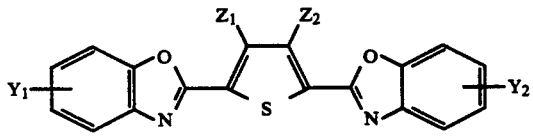
(3)

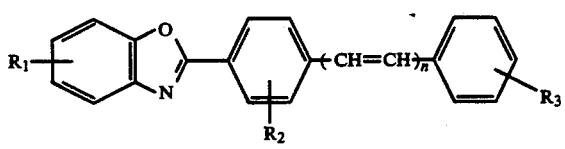
(4)

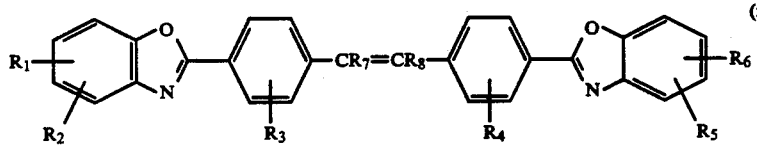
(5)

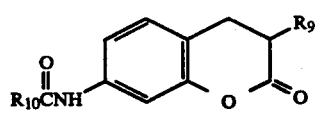
(6)

As binders for the image receiving layer and the upper layer provided thereon, there may be used each alone or in combination water-soluble polymer compounds such as gelatin, phthalized gelatin, acylated gelatin, phenylcarbamylated gelatin, carboxymethyl cellulose, hydroxyethyl cellulose, sodium alginate, polyvinyl alcohol, partially saponified polyvinyl alcohol, heat-processed products of polyvinyl alcohol and maleic anhydride copolymers (for example, styrene-maleic anhydride copolymer and ethylene-maleic anhydride copolymer), polyacrylamides, poly-N-vinylpyrrolidone, and latexes (for example, polyacrylate esters, polymethacrylate esters, polystyrenes, and polybutadienes each alone or in the form of copolymer).

In the present invention, coating solution for the image receiving layer containing physical development nuclei is preferably prepared so that when it is singly wherein $Y_1$ and $Y_2$ each represents an alkyl group, $Z_1$ and $Z_2$ each represents a hydrogen atom or an alkyl group, n represents 1 or 2, $R_1$, $R_2$, $R_3$, $R_4$, $R_5$ and $R_6$ each represents an aryl group, an alkyl group, an alkoxy group, an aryloxy group, a hydroxyl group, an amino group, a cyano group, a carboxyl group, an amide group, an ester group, an alkylcarbonyl group, an alkylsulfo group, a dialkylsulfonyl group, a halogen atom or a hydrogen atom, $R_7$ and $R_8$ each represents a hydrogen atom, an alkyl group such as methyl group, ethyl group or the like, or a cyano group, $R_9$ represents a phenyl group, a halogen atom or an alkyl substituted phenyl group, and $R_{10}$ represents an amino group or an organic primary or secondary amino group.

Examples of the oil-soluble fluorescent brightening agents having the above formulas (3)-(6) used in the present invention are shown below.

No. 1
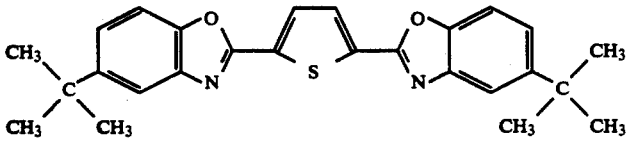
No. 2
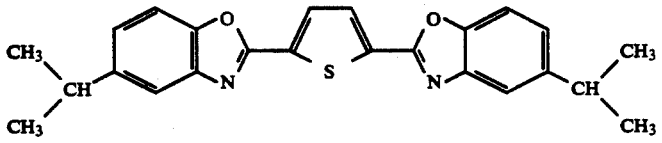
No. 3
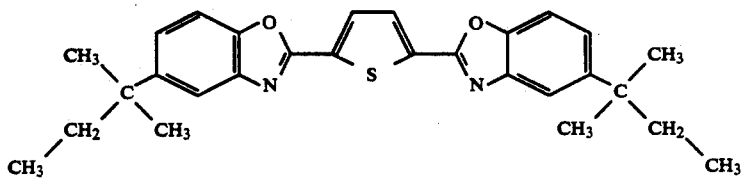
No. 4
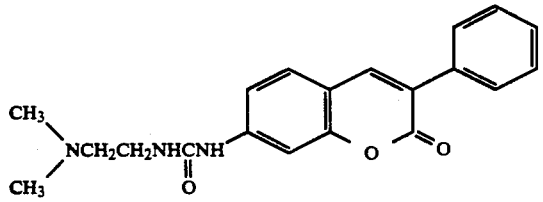
No. 5
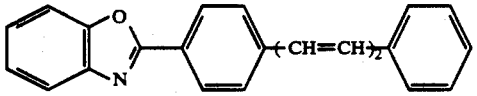
No. 6
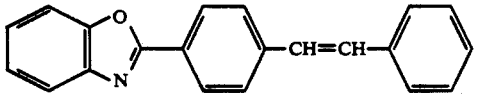
No. 7
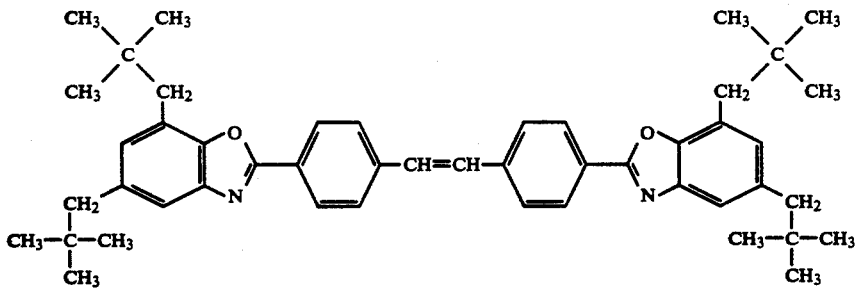
No. 8
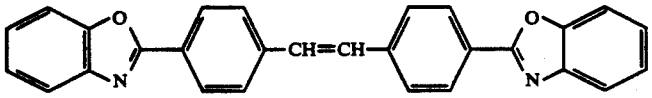
No. 9
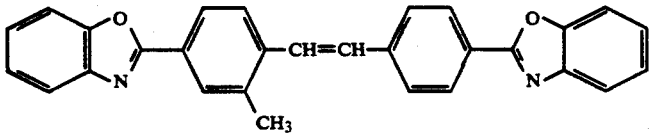

-continued
No. 10
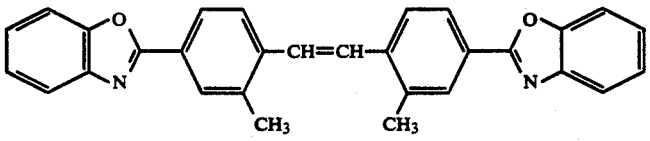
No. 11
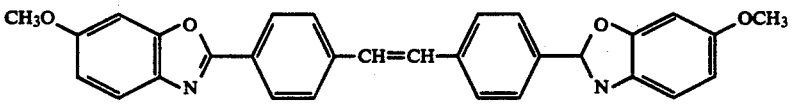
No. 12
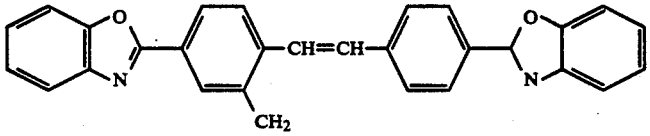
No. 13
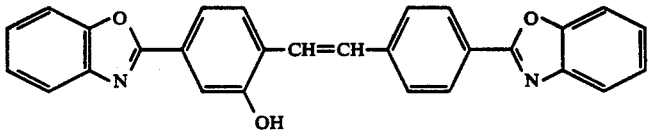
No. 14
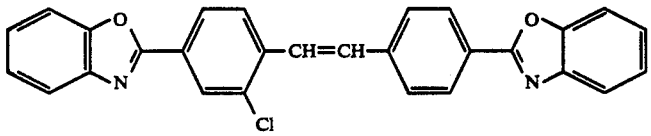
No. 15
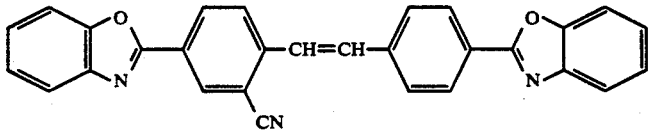
The oil-soluble fluorescent brightening agents having the above formulas (3)–(6) used in the present invention are never limited to the above examples.
The fluorescent brightening agents may be those which do not have the formulas (3)–(6) as exemplified below. Of course, these are also not limitative.
No. 16
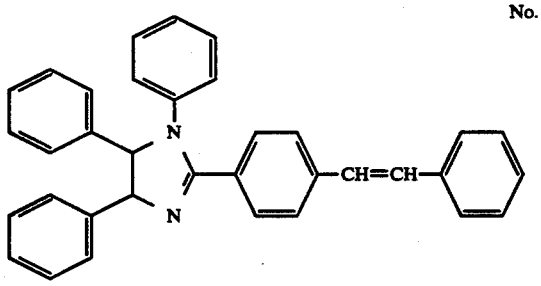
No. 17
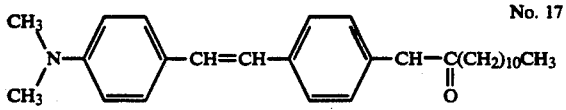
-continued
No. 18
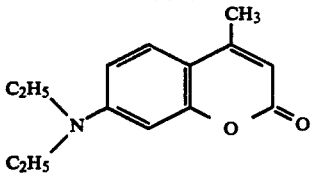
No. 19
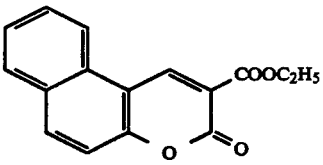
No. 20
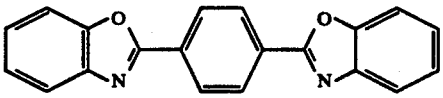
No. 21
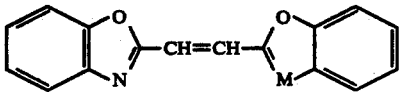
No. 22
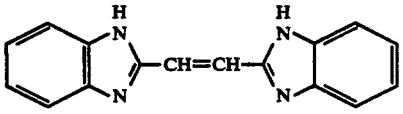

-continued

No. 23

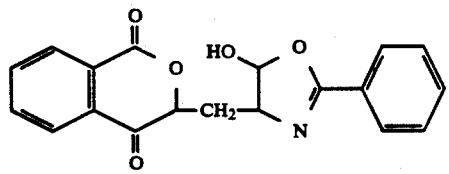

Emulsified dispersions of these oil-soluble fluorescent brightening agents can be prepared, for example, by dissolving the fluorescent brightening agent in a high-boiling organic solvent as shown in British Pat. No. 1,072,915 and emulsifying and dispersing the solution in a hydrophilic colloid such as gelatin together with a surface active agent. As the high-boiling organic solvent, there may be generally used phthalate esters and phosphate esters as mentioned in U.S. Pat. Nos. 2,322,027, 3,676,137 and 3,779,765, West German Patent No. 1,152,610, British Patent No. 1,272,561, Japanese Patent Kokai Nos. 53-1520 and 55-25057, and Japanese Patent Kokoku No. 45-37376. Of course, these are not limitative and amide compounds, benzoate esters and substituted paraffins as described in U.S. Pat. No. 3,416,923 and the like may also be used.

If amount of the fluorescent brightening agent used is too small, the effect to improve whiteness is not sufficiently exerted and if it is too large, the portion of high image density becomes bluish to cause so-called blooming (aubergine purple), resulting in reduction of apparent image density. Luminous efficiency of fluorescence cannot be generically said because it varies depending on kind of the fluorescent brightening agent, kind of the oil used for emulsification, concentration, and presence of various quenchers or other UV absorbers, but it is most preferred to use the fluorescent brightening agent in an amount of 3-300 mg/m$^2$.

Proportion of the emulsifying oil to the fluorescent brightening agent is most suitably selected considering solubility, concentration and quenching of the fluorescent brightening agent.

The image receiving layer and the hydrophilic colloid layer provided thereon can be hardened with suitable hardeners, but the image receiving materials markedly improved in quality of the present invention can be stably produced by coating a coating solution which contains at least one compound represented by the following formulas (1) and (2) as a hardener and which is adjusted to a pH of 5.5 or less.

(1)

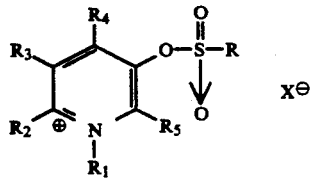

(2)

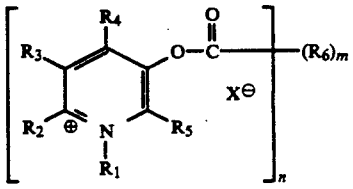

wherein R represents an alkyl group or an aryl group, $R_1$ represents an alkyl group or an aralkyl group with a proviso that when $R_1$ is a group containing a sulfo group or a carboxyl group, $X^-$ is not present, $X^-$ represents an anion, $R_2$, $R_3$, $R_4$ and $R_5$ each represents a hydrogen atom, an alkyl group, an alkenyl group or an alkoxy group, and $R_2$, $R_3$, $R_4$ and $R_5$ may be identical or different or $R_2$ and $R_3$ or $R_3$ and $R_4$ may link to each other to form a carbon ring, $R_6$ represents a carbon atom or a nitrogen atom and shows a residue having a valence of n which links to a carbonyl carbon constituting a carboxylate ester, n represents 2, 3 or 4 and m represents 0 or 1.

The alkyl group represented by R in the above formula may be of straight chain or branched chain and besides, may be substituted with suitable groups (e.g., halogens and alkoxy groups).

The alkyl group is preferably those of 1-10 carbon atoms such as methyl, ethyl, n-propyl, n-hexyl and trichloromethyl. The aryl group represented by R is preferably aromatic group such as phenyl group or naphthyl group and these aromatic groups may be substituted with suitable groups (e.g., halogens, alkyl groups and nitro group).

The alkyl group represented by $R_1$ may be of straight chain or branched chain and besides, may be substituted with suitable groups (e.g., sulfo group and carboxyl group).

The alkyl group is preferably those of 1-10 carbon atoms such as methyl, ethyl, n-propyl, n-hexyl, carboxymethyl and sulfopropyl. The aralkyl group may be of straight chain or branched chain and besides, may be substituted with suitable groups (e.g., sulfo group and carboxyl group). The aralkyl group is preferably those of 7-15 carbon atoms such as benzyl, phenethyl, phenylpropyl and 2-carboxybenzyl. When $R_1$ is a group containing a sulfo group or a carboxyl group, $X^-$ is not present.

$X^-$ represents an anion and is preferably a halogen ion, an alkylsulfonate ion or an arylsulfonate ion.

The alkyl group represented by $R_2$, $R_3$, $R_4$ and $R_5$ may be of straight chain or branched chain and is preferably those of 1-10 carbon atoms such as methyl, ethyl, n-propyl, i-propyl, n-butyl, tert-butyl and n-hexyl. The alkenyl group may be of straight chain or branched chain and is preferably those of 1-8 carbon atoms such as allyl, butenyl and octenyl.

The alkoxy group represented by $R_2$-$R_5$ includes, for example, methoxy, ethoxy, n-propoxy, n-butoxy, n-octoxy and benzyloxy. When $R_2$ and $R_3$ or $R_3$ and $R_4$ link to each other to form a carbon ring, the carbon ring includes, for example, benzene ring and 8- to 14-membered condensed rings, preferably naphthalene ring. These carbon rings may have substituent.

Among the compounds represented by the formulas (1) and (2), especially preferred are those which have the formulas in which all of $R_2$, $R_3$, $R_4$ and $R_5$ are hydrogen atoms or $R_2$ and $R_3$ or $R_3$ and $R_4$ link to each other to form a benzene ring.

Examples of $R_6$ include alkylene groups such as ethylene, propylene, 1,2-dimethylethylene, tetramethylene and octamethylene; alkenylene groups such as vinylene, ethynylene and propenylene; cycloalkylene groups such as 1,3-cyclopentylene and 1,4-cyclohexylene; arylene groups such as m-phenylene, p-phenylene and 1,3-naphthylene; alkylenediimino groups such as tetramethylenediimino and hexamethylenediimino; 1,4-cyclohexylenediimino; and 1,3-phenylenediimino.

Examples of the compounds represented by the formulas (1) and (2) are shown below, but these are never limitative.
No. 1
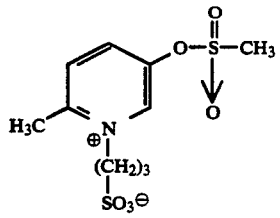
No. 2
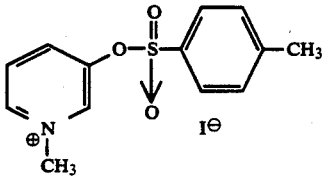
No. 3
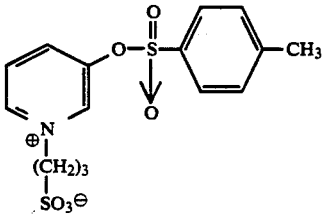
No. 4
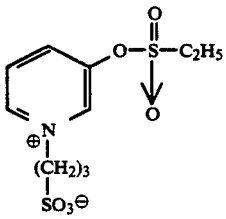
No. 5
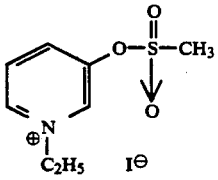
No. 6
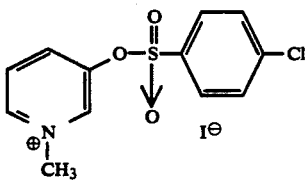
No. 7
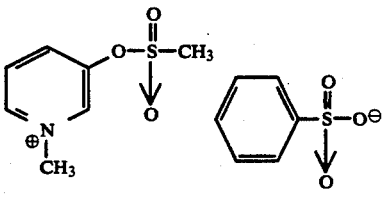
-continued
No. 8
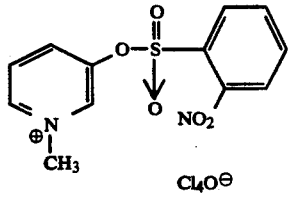
No. 9
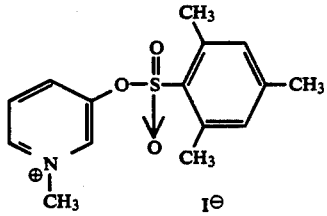
No. 10
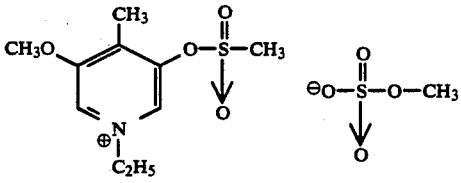
No. 11
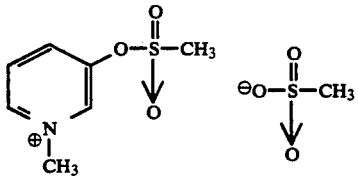
No. 12
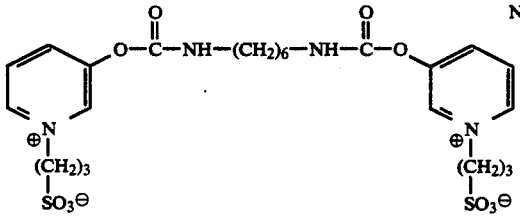
No. 13
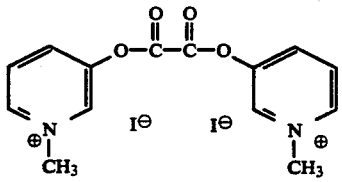
No. 14
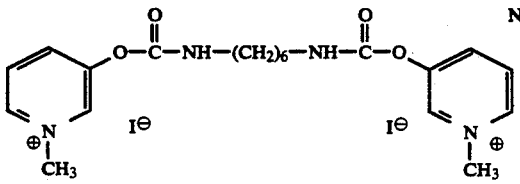

-continued

No. 15

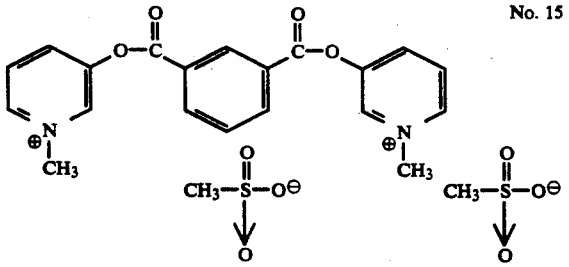

No. 16

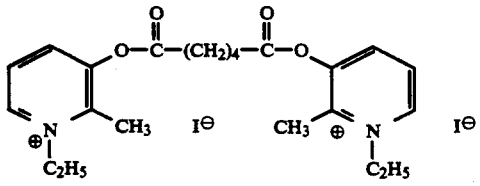

No. 17

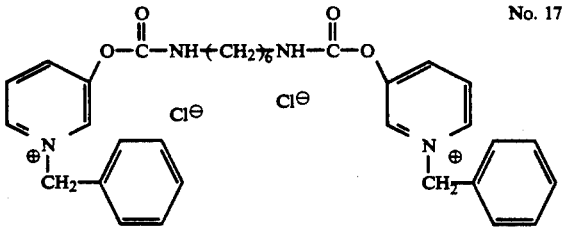

No. 18

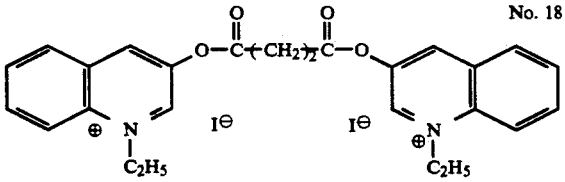

No. 19

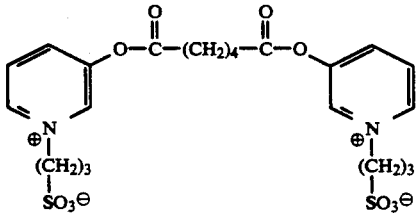

No. 20

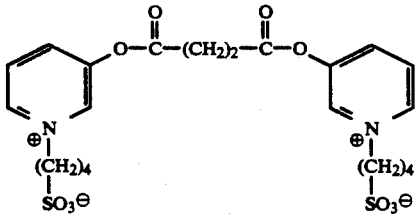

No. 21

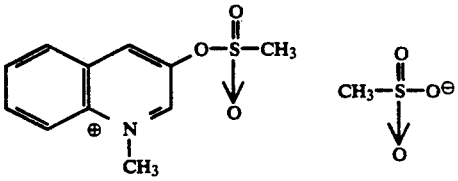

-continued

No. 22

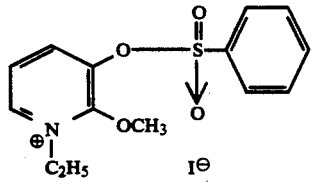

No. 23

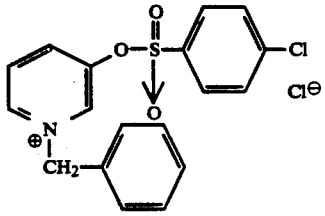

No. 24

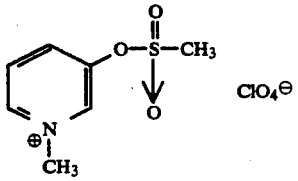

The compounds represented by the formulas (1) and (2) can be very easily synthesized in accordance with Japanese Patent Kokai Nos. 56-36645 and 59-20369.

pH of coating solution can be adjusted using organic acids such as acetic acid and inorganic acids such as hydrochloric acid and sulfuric acid.

The pH of the coating solution used in the present invention is preferably 5.5 or less, more preferably 5.0 or less.

In case the hardener is added to the coating solution for formation of a gelatin film, the addition amount thereof which may vary depending on kind of the objective gelatin film, physical properties thereof and photographic characteristics is generally 0.01–100% by weight, preferably 0.1–10% by weight based on the dry weight of gelatin in the coating solution.

The hardeners may be used each alone or in combination of two or more and furthermore may be used in combination with known hardeners, for example, aldehyde compounds such as formaldehyde and glutaraldehyde, compounds having reactive halogens described in U.S. Pat. Nos. 3,288,775 and 2,732,303 and British Patent Nos. 974,723 and 1,167,207, ketone compounds such as diacetyl and cyclopentadione, bis(2-chloroethylurea), 2-hydroxy-4,6-dichloro-1,3,5-triazine, divinyl sulfone, 5-acetyl-1,3-diacryloyl, hexahydro-1,3,5-triazine, compounds having reactive olefins described in U.S. Pat. Nos. 3,635,718 and 3,232,763 and British Patent No. 994,809, N-hydroxymethylphthalimide, N-methylol compounds described in U.S. Pat. Nos. 2,732,316 and 2,586,168, isocyanates described in U.S. Pat. No. 3,103,437, aziridine compounds described in U.S. Pat. Nos. 3,107,280 and 2,983,611, acid derivatives described in U.S. Pat. Nos. 2,725,294 and 2,725,295, carbodiimide compounds described in U.S. Pat. No. 3,100,704, epoxy compounds described in U.S. Pat. No. 3,091,537, isoxazole compounds described in U.S. Pat. Nos. 3,321,313 and 3,543,292, halogenocarboxyaldehydes such as mucochloric acid, dioxane derivatives such as dihydroxydioxane and dichlorodioxane, and inorganic hardeners such as chrome alum, zirconium sulfate and chromium trichloride.

The image receiving layer and the upper layer provided thereon can contain surface active agents, for example, natural surface active agents such as saponin, nonionic surface active agents such as alkylene oxide type, glycerin type, and glycidol type, cationic surface active agents such as higher alkylamines, quaternary ammonium salts, heterocyclic ring compounds, e.g., pyridine, and sulfonium compounds, anionic surface active agents containing acid groups such as carboxylic acids, sulfonic acid, phosphoric acid, sulfate esters, and phosphate esters, amphoteric surface active agents such as amino acids, aminosulfonic acids, sulfate esters or phosphate esters of amino alcohol and fluorine-containing anionic and amphoteric surface active agents, matting agents, fluorescent dyes, discoloration inhibitors, color toning agents, developing agents such as hydroquinone and derivatives thereof and 1-phenyl-3-pyrazolidone and derivatives thereof, and silver halide solvents such as sodium thiosulfate, ammonium thiosulfate and potassium thiocyanate.

Silver halide emulsions used in the photosensitive layer of photosensitive materials used for silver complex diffusion transfer process according to the present invention may be those which are commonly used for diffusion transfer process and there are no severe limitations in the composition of the emulsions as far as the silver salts have developability and diffusibility respectively in exposed portion and unexposed portion at the speed necessary for diffusion transfer process. For example, mention may be made of silver bromide, silver iodide, silver chloride, silver chlorobromide, silver iodobromide, silver chloroiodide, silver chloroiodobromide and mixtures thereof.

The silver halide emulsions can be sensitized by various processes during preparation or coating. For example, they may be chemically sensitized by processes known in this technical field with sodium thiosulfate, alkylthioureas, gold compounds such as gold rhodanide and gold chloride or mixtures thereof. Furthermore, they can also be spectrally sensitized by usual processes.

As binders for the photosensitive layer, there may be used polymeric materials normally used for preparation of silver halide emulsions, for example, those which are used for the image receiving materials. Moreover, the photosensitive layer can be hardened with suitable hardeners used for the image receiving layer. Furthermore, the photosensitive layer may contain additives usually employed for silver halide photosensitive materials such as surface active agents, antifoggants, fluorescent dyes, developing agents, for example, hydroquinone and derivatives thereof and 1-phenyl-3-pyrazolidone and derivatives thereof. In addition to the photosensitive layer, there may be provided auxiliary layers such as undercoat layer, intermediate layer, protective layer, and peeling layer.

Supports used for the Photosensitive materials and image receiving materials for silver complex diffusion transfer process according to the present invention may be any of those which are normally used. Examples thereof are paper, glass, films such as cellulose acetate film, polyvinyl acetal film, polystyrene film and polyethylene phthalate film, a metal support clad with papers on both sides, a paper support coated with α-olefin polymers such as polyethylene on one or both sides.

In general, the silver complex diffusion transfer process includes so-called "mono-sheet type" according to which a photosensitive material and an image receiving material are formed on one same support an so-called "two-sheet type" according to which a photosensitive material and an image receiving material are respectively formed on separate supports and, in use, these two materials are brought into contact with each other, are pressed between rollers to carry out diffusion transfer and then are separated from each other. The present invention can be applied to both of them.

Processing solutions for silver complex diffusion transfer process used in the present invention can be those which are normally used for silver complex diffusion transfer process. That is, the processing solutions can contain additives, for example, developing agents for developing exposed silver halide, such as hydroquinone an derivatives thereof and 1-phenyl-3-pyrazolidone and derivatives thereof, solvents for unexposed silver halide such as sodium thiosulfate, ammonium thiosulfate, sodium thiocyanate and potassium thiocyanate, preservatives such as sodium sulfate, development retarders such as potassium bromide, and color toning agents such as 1-phenyl-5-mercaptotetrazole, alkaline substances such as sodium hydroxide, potassium hydroxide, lithium hydroxide and trisodium phosphate and thickening agents such as carboxymethyl cellulose and hydroxyethyl cellulose.

The present invention will be explained by the following nonlimiting examples.

PRODUCTION OF PHOTOSENSITIVE MATERIAL

An undercoat layer containing carbon black for inhibition of halation was provided on one side of a paper support of 110 g/m$^2$ coated with polyethylene on both sides. On this undercoat layer was provided a gelatin silver halide emulsion layer containing orthochromatically sensitized silver chlorobromide (silver bromide 2 mol %) having an average grain size of 0.35 μ in an amount of 2.0 g/m$^2$ in terms of silver nitrate, 0.2 g/m$^2$ of 1-phenyl-3-pyrazolidone, 0.7 g/m$^2$ of hydroquinone and 4 g/m$^2$ of gelatin. Thus, a photosensitive material was obtained.

PREPARATION OF PROCESSING SOLUTION FOR DIFFUSION TRANSFER PROCESS

A processing solution for diffusion transfer having the following composition was used.

| | |
|---|---|
| Water | 800 ml |
| Sodium hydroxide | 4 g |
| Anhydrous sodium sulfite | 50 g |
| Hydroquinone | 12 g |
| 1-Phenyl-3-pyrazolidone | 3 g |
| Sodium thiosulfate (pentahydrate) | 20 g |
| N-methylamino ethanol | 15 g |
| 1-Phenyl-5-mercaptotetrazole | 50 g |
| Potassium bromide | 1 g |
| Water added to make up 1 l. | |

PREPARATION OF PHYSICAL DEVELOPMENT NUCLEI

Physical development nuclei A: 100 ml of 5 wt % aqueous solution of photographic gelatin was kept at 40° C. and mixed with 35 ml of 0.05 mol/l aqueous solution of sodium sulfide and 35 ml of 0.1 mol/l aqueous solution of silver nitrate under well stirring to prepare physical development nuclei A.

Physical development nuclei B: 100 ml of 5 wt % aqueous solution of photographic gelatin was kept at 40° C. and mixed with 35 ml of 0.05 mol/l aqueous solution of sodium sulfide, 22.5 ml of 0.05 mol/l aqueous solution of nickel nitrate and 12.5 ml of 0.1 mol/l aqueous solution of silver nitrate in this order at an interval of 3 minutes under well stirring to prepare physical development nuclei 8.

Physical development nuclei C: 100 ml of 5 wt % aqueous solution of photographic gelatin was kept at 40° C. and mixed with 35 ml of 0.05 mol/l aqueous solution of silver nitrate and 35 ml of 0.05 mol/l aqueous solution of sodium borohydride under well stirring to prepare physical development nuclei C.

Physical development nuclei D: Physical development nuclei D were prepared in the same manner as in preparation of physical development nuclei A except that low molecular weight gelatin having an average molecular weight of about 10,000 was used in place of the photographic gelatin.

Physical development nuclei E: Physical development nuclei E were prepared in the same manner as in preparation of physical development nuclei B except that low molecular weight gelatin having an average molecular weight of about 10,000 was used in place of the photographic gelatin.

Physical development nuclei F: Physical development nuclei F were prepared in the same manner as in preparation of physical development nuclei C except that low molecular weight gelatin having an average molecular weight of about 10,000 was used in place of the photographic gelatin.

PREPARATION OF EMULSION OF FLUORESCENT BRIGHTENING AGENT

Compound No. 1 exemplified above as oil-soluble fluorescent brightening agent was dissolved in 100 g of n-dioctyl phthalate and 200 ml of ethyl acetate. The resulting solution was mixed with 600 ml of 6% aqueous gelatin solution containing 1.5 g (in solid content) of sodium di(2-ethylhexyl)succinate at about 60° C. and the mixture was vigorously stirred by a homogenizer to prepare an emulsified dispersion.

PRODUCTION OF IMAGE RECEIVING MATERIAL

A polyethylene laminated paper of 90 g/m$^2$ previously subjected to corona discharge treatment was used as a support.

Coating solutions for image receiving layer were prepared so that the solutions contained 1 g/m$^2$ of physical development nuclei A–F prepared hereabove, respectively and gelatin as hydrophilic colloid in an amount of 0.8 g/m$^2$ in dry weight.

Coating solution for upper layer containing no physical development nuclei was prepared so that it contained 80 mg/m$^2$ of compound No. 7 exemplified hereabove as a hardener and gelatin as a hydrophilic colloid in an amount of 1.2 g/m$^2$ in dry weight. The hardener was added to the coating solution just before coating.

Production condition I: The coating solution for image receiving layer was coated on the support and dried and then, the coating solution for upper layer was coated on the image receiving layer and was dried in such a manner that drying was initiated at 30° C. and terminated at 70° C. Thus, Samples I were produced. Here, 1-phenyl-5-mercaptotetrazole was contained in only the image receiving layer in an amount of 100 mg/m$^2$ in Samples (I-A-1) - (I-F-1), was contained in the image receiving layer in an amount of 40 mg/m$^2$ and in the upper layer in an amount of 60 mg/m$^2$ in Samples (I-A-2)-(I-F-2) and was contained in only the upper layer in an amount of 100 mg/m$^2$ in Samples (I-A-3)-(I-F-3). These names of samples mean that they contained either one of physical development nuclei A–F.

Production condition II: The coating solution for image receiving layer and the coating solution for upper layer were simultaneously coated on the support by extrusion method and the gelatin binder was set at 0° C. and thereafter, the temperature was gradually raised to dry the coat in such a manner that the drying was terminated at 50° C. Thus, Comparative Samples (II-A-1)-(II-F-1), (II-A-2)-(II-F-2) and (II-A-3)-(II-F-3) in which 1-phenyl-5-mercaptotetrazole was contained in the same manner as in the above production condition I were respectively produced.

Production condition III: Samples were produced in the same construction as the Sample (I-E-3) produced under production condition I except that 1.5 g/m$^2$ of the above emulsified dispersion of fluorescent brightening agent was contained in only the image receiving layer in Sample (III-a), in only the upper layer in Sample (III-b) and equally in both the layers in Sample (III-c).

Production condition IV: Samples were produced in the same construction as in Sample (III-a) produced under production condition III except that the coating solutions for upper layer containing the hardener which were adjusted to pH 4.5, 5.5 and 6.5 were coated just after addition of the hardener [Samples (IV-4.5-0), (IV-5.5-0) and (IV-6.5-0), respectively] and coated after lapse of 8 hours at 40° C. from addition of the hardener [Samples (IV-4.5-8), (IV-5.5-8) and (IV-6.5-8), respectively]. In these names of the samples, "4.5", "5.5" and "6.5" mean pH values of the coating solutions and "0" means that the coating solution was coated just after addition of the hardener and "8" means that the solution was coated after lapse of 8 hours from addition of the hardener.

DEVELOPMENT AND EVALUATION OF RESULTS

The photosensitive materials produced above were exposed imagewise and the exposed photosensitive material and the image receiving material were put together so that the surface of the emulsion layer of the photosensitive material was brought into close contact with the surface of the image receiving layer of the image receiving material and were passed through a processor having squeeze rollers and containing the above processing solution for diffusion transfer and were separated from each other after 30 seconds from leaving the squeeze rollers.

The image receiving material was washed with water and dried. Thereafter, Samples I and II were evaluated on reflection density of transfer silver image, color tone of image and texture of image portion. The results are shown in Table 1.

Samples III were evaluated on reflection density of transfer silver image and whiteness of non-image portion. The results are shown in Table 2.

Samples IV were evaluated on mechanical strength in the following manner: The sample was washed with water for 30 seconds and then, a ball point needle having a diameter of 0.5 mm was stood perpendicularly on the surface of film of the layer and was moved in parallel on the surface at a speed of 1 cm/sec under a load.

The strength was expressed by the load (g) required for causing damage on the surface of the transfer silver image. The results are shown in Table 3.

TABLE 1

| Sample | $D_{max}$ | Color tone | Texture | Evaluation |
|---|---|---|---|---|
| I-A-1 | 1.52 | Pure black | 2 | 1 |
| I-B-1 | 1.54 | Pure black | 2 | 1 |
| I-C-1 | 1.53 | Pure black | 2 | 1 |
| I-D-1 | 1.54 | Bluish black | 2 | 1 |
| I-E-1 | 1.58 | Bluish black | 2 | 1 |
| I-F-1 | 1.57 | Pure black | 2 | 1 |
| I-A-2 | 1.61 | Pure black | 3 | 2 |
| I-B-2 | 1.65 | Pure black | 3 | 2 |
| I-C-2 | 1.64 | Pure black | 3 | 2 |
| I-D-2 | 1.70 | Bluish black | 3 | 3 |
| I-E-2 | 1.73 | Pure black | 4 | 3 |
| I-F-2 | 1.71 | Pure black | 4 | 3 |
| I-A-3 | 1.74 | Pure black | 5 | 4 |
| I-B-3 | 1.78 | Pure black | 5 | 4 |
| I-C-3 | 1.76 | Pure black | 5 | 4 |
| I-D-3 | 1.85 | Pure black | 5 | 5 |
| I-E-3 | 1.92 | Pure black | 5 | 5 |
| I-F-3 | 1.87 | Pure black | 5 | 5 |
| II-A-1 | 1.41 | Pure black | 1 | 1 |
| II-B-1 | 1.43 | Pure black | 1 | 1 |
| II-C-1 | 1.43 | Pure black | 1 | 1 |
| II-D-1 | 1.52 | Bluish black | 1 | 1 |
| II-E-1 | 1.51 | Bluish black | 1 | 1 |
| II-F-1 | 1.54 | Pure black | 1 | 1 |
| II-A-2 | 1.55 | Pure black | 1 | 1 |
| II-B-2 | 1.57 | Pure black | 1 | 1 |
| II-C-2 | 1.56 | Pure black | 1 | 1 |
| II-D-2 | 1.62 | Bluish black | 1 | 1 |
| II-E-2 | 1.64 | Pure black | 1 | 1 |
| II-F-2 | 1.62 | Pure black | 1 | 1 |
| II-A-3 | 1.65 | Pure black | 2 | 2 |
| II-B-3 | 1.66 | Warm black | 2 | 2 |
| II-C-3 | 1.64 | Warm black | 2 | 2 |
| II-D-3 | 1.68 | Pure black | 3 | 3 |
| II-E-3 | 1.70 | Pure black | 3 | 3 |
| II-F-3 | 1.67 | Pure black | 3 | 3 |

Grades on the results of evaluation shown in Table 1 are as follows.

1: Extremely bad.
2: Bad.
3: Practically acceptable.
4: Good.
5: Very good.

It can be seen that the Samples (I-A-3)-(I-F-3) of the present invention are superior to other comparative samples in all of reflection density, color tone and texture and especially (I-D-3)-(I-F-3) have extremely good quality.

TABLE 2

| Samples | Reflection density | Evaluation of whiteness |
|---|---|---|
| III-a | 1.91 | Good white. |
| III-b | 1.77 | The white portion was good, but the image portion was bluish purple. |
| III-c | 1.83 | Somewhat yellowish white. |

It can be seen that the Sample (III-a) of the present invention is improved in whiteness without reduction in reflection density to be caused by addition of the fluorescent brightening agent.

TABLE 3

| | Mechanical strength of film | | | |
|---|---|---|---|---|
| pH | Sample | No lapse of time | Sample | Lapse of 8 hours |
| 4.5 | IV-4.5-0 | At least 200 g | IV-4.5-8 | 124 g |
| 5.5 | IV-5.5-0 | At least 200 g | IV-5.5-8 | 96 g |

TABLE 3-continued

| | Mechanical strength of film | | | |
|---|---|---|---|---|
| pH | Sample | No lapse of time | Sample | Lapse of 8 hours |
| 6.5 | IV-6.5-0 | At least 200 g | IV-6.5-8 | 37 g |

Mechanical strength of the product is desired to be at least 60 g and it can be seen that storage stability of the coating solution for up to 8 hours has been sufficiently attained by adjusting pH of the solution to 5.5 or less.

As can be seen from the results of Example, the image receiving materials for silver complex diffusion transfer process of the present invention give images with no bronzing and excellent in color tone and texture with keeping high density and superior in whiteness and can be stably produced. Thus, the image receiving materials are excellent in over-all qualities.

What is claimed is:

1. An image receiving material for silver complex diffusion transfer process which comprises a support, an image receiving layer provided on the support and an upper layer provided on the image receiving layer wherein physical development nuclei are distributed densely in the vicinity of the surface of the support and gradually diminishing towards the upper layer and a color toning agent is contained densely in the upper layer and gradually diminishing towards the surface of the support and the physical development nuclei and the color toning agent are thus mutually distributed.

2. An image receiving layer according to claim 1 which is produced by coating on a support a hydrophilic colloid coating solution for image receiving layer which contains physical development nuclei and contains substantially no color toning agent and thereon at least one hydrophilic colloid coating solution which contains at least one color toning agent and contains substantially no physical development nuclei.

3. An image receiving layer according to claim 1, wherein the physical development nuclei are prepared by reducing or sulfurizing a heavy metal ion in a solution containing low molecular weight gelatin as defined in the specification.

4. An image receiving material according to claim 2, wherein at least one of the coating solutions other than the coating solution for uppermost layer contains an emulsified dispersion of an oil-soluble fluorescent brightening agent.

5. An image receiving material according to claim 2, wherein the coating solution contains gelatin as hydrophilic colloid and at least one compound represented by the following formulas (1) and (2) and is adjusted to a pH of 5.5 or less:

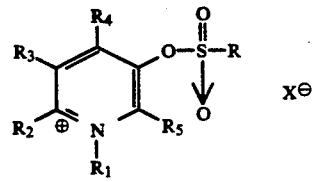

(1)

-continued (2)

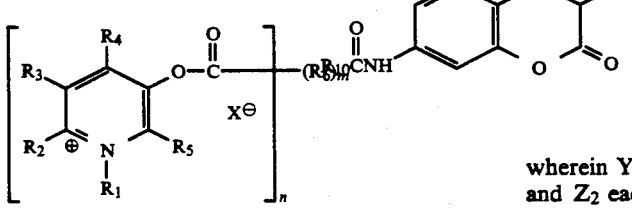

wherein R represents an alkyl group or an aryl group, $R_1$ represents an alkyl group or an aralkyl group with a proviso that when $R_1$ is a group containing a sulfo group or a carboxyl group, $X^-$ is not present, $X^-$ represents an anion, $R_2$, $R_3$, $R_4$ and $R_5$ each represents a hydrogen atom, an alkyl group, an alkenyl group or an alkoxy group, and $R_2$, $R_3$, $R_4$ and $R_5$ may be identical or different or $R_2$ and $R_3$ or $R_3$ and $R_4$ may link to each other to form a carbon ring, $R_6$ represents a carbon atom or a nitrogen atom and shows a residue having a valence of n which links to a carbonyl carbon which constitutes a carboxylate ester, n represents 2, 3 or 4 and m represents 0 or 1.

6. An image receiving material according to claim 4, wherein the fluorescent brightening agent is represented by one of the following formulas (3)–(6).

(3)

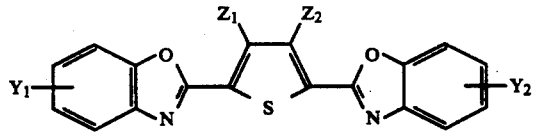

(4)

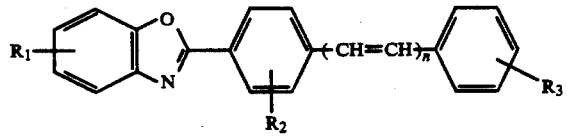

(5)

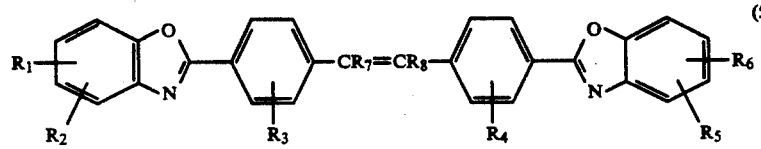

(6)

wherein $Y_1$ and $Y_2$ each represents an alkyl group, $Z_1$ and $Z_2$ each represents a hydrogen atom or an alkyl group, n represents 1 or 2, $R_1$, $R_2$, $R_3$, $R_4$, $R_5$ and $R_6$ each represents an aryl group, an alkyl group, an alkoxy group, an aryloxy group, a hydroxyl group, an amino group, a cyano group, a carboxyl group, an amide group, an ester group, an alkylcarbonyl group, an alkylsulfo group, a dialkylsulfonyl group, a halogen atom or a hydrogen atom, $R_7$ and $R_8$ each represents a hydrogen atom, an alkyl group or a cyano group, $R_9$ represents a phenyl group, a halogen atom or an alkyl-substituted phenyl group, and $R_{10}$ represents an amino group or an organic primary or secondary amino group.

* * * * *